US007787980B2

(12) United States Patent
Gretsch et al.

(10) Patent No.: US 7,787,980 B2
(45) **Date of Patent: *Aug. 31, 2010**

(54) METHODS AND A DEVICE FOR THE REGULATION OF THE WEB TENSION IN A MULTI-WEB SYSTEM

(75) Inventors: Harald Karl Gretsch, Eibelstadt (DE); Reinhard Georg Groβ, Dettelbach (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 315 days.

This patent is subject to a terminal disclaimer.

(21) Appl. No.: 11/998,407

(22) Filed: Nov. 30, 2007

(65) Prior Publication Data

US 2008/0091292 A1 Apr. 17, 2008

Related U.S. Application Data

(63) Continuation of application No. 10/529,214, filed as application No. PCT/DE03/02998 on Sep. 10, 2003, now Pat. No. 7,322,291.

(30) Foreign Application Priority Data

Sep. 27, 2002 (DE) ..... 102 45 587
Jan. 27, 2003 (DE) ..... 103 03 122

(51) Int. Cl.
*G06F 19/00* (2006.01)

(52) U.S. Cl. ..... 700/122; 101/483

(58) Field of Classification Search ..... 700/122, 700/124, 127, 128; 101/493, DIG. 42
See application file for complete search history.

(56) References Cited

U.S. PATENT DOCUMENTS 3,505,713 A * 4/1970 Williams et al. ..... 28/165
4,667,946 A * 5/1987 Taguchi et al. ..... 270/52.11
5,048,810 A * 9/1991 Palmatier et al. ..... 270/52.08
5,117,610 A * 6/1992 Hartman et al. ..... 53/411
5,290,023 A 3/1994 Sasaki et al.
5,397,044 A 3/1995 Suzuki
5,449,156 A 9/1995 Gnuechtel et al.
5,582,400 A 12/1996 Seydel (Continued)

FOREIGN PATENT DOCUMENTS

DE 42 27 814 A1 2/1993

(Continued)

OTHER PUBLICATIONS

Technical University of Chemnitz, "Dissertation," p. 118-128, (Apr. 16, 1998).

*Primary Examiner*—Albert DeCady
*Assistant Examiner*—Chad Rapp
(74) *Attorney, Agent, or Firm*—Jones, Tullar & Cooper, P.C.

(57) ABSTRACT

The tension of a web in a multi-web system is regulated. At least two webs initially run through a first processing step independently of each other and are subsequently combined with each other to form one resultant web strand. The web tensions of these two initially independent webs are adjusted to each other through a first regulation process. Each of these webs has its web tension regulated on the separate web path by a dedicated second regulation process which is different from the first regulation process.

38 Claims, 7 Drawing Sheets

U.S. PATENT DOCUMENTS

| | | | | |
|---|---|---|---|---|
| 5,937,756 | A | 8/1999 | Kishine et al. | |
| 6,211,968 | B1 | 4/2001 | Glockner et al. | |
| 6,314,333 | B1 | 11/2001 | Rajala et al. | |
| 6,532,872 | B2 | 3/2003 | Siegl et al. | |
| 6,546,871 | B1 | 4/2003 | Glockner | |
| 6,647,874 | B1 | 11/2003 | Siegl et al. | |
| 6,766,737 | B2 | 7/2004 | Glockner et al. | |
| 6,782,818 | B2 | 8/2004 | Glockner et al. | |
| 6,810,812 | B2 | 11/2004 | Fischer | |
| 7,040,231 | B2 | 5/2006 | Schaede | |
| 7,040,233 | B2 | 5/2006 | Seyfried | |
| 7,322,291 | B2 * | 1/2008 | Gretsch et al. | 101/483 |

FOREIGN PATENT DOCUMENTS

| | | | |
|---|---|---|---|
| DE | 42 33 855 | A1 | 4/1994 |
| DE | 43 08 194 | A1 | 9/1994 |
| DE | 43 28 445 | A1 | 3/1995 |
| DE | 44 31 927 | A1 | 4/1995 |
| DE | 35 90 386 | C2 | 7/1998 |
| DE | 199 36 291 | A1 | 3/2001 |
| DE | 199 42 031 | A1 | 3/2001 |
| DE | 199 52 388 | A1 | 6/2001 |
| DE | 100 27 471 | | 8/2001 |
| EP | 0 919 498 | A2 | 6/1999 |
| EP | 0 837 825 | B1 | 1/2001 |
| JP | 5-330710 | | 12/1993 |
| WO | WO 97/02952 | | 1/1997 |

* cited by examiner

METHODS AND A DEVICE FOR THE REGULATION OF THE WEB TENSION IN A MULTI-WEB SYSTEM

CROSS-REFERENCE TO RELATED APPLICATIONS

This U.S. patent application is a continuation of U.S. application Ser. No. 10/529,214, filed Mar. 25, 2005 now U.S. Pat. No. 7,322,291. That application is the U.S. national phase, under 35 USC 371, of PCT/DE2003/002998, filed Sep. 10, 2003; published as WO 2004/031059 A2 and A3 on Apr. 15, 2004, and claiming priority to DE 102 45 587.2 filed Sep. 27, 2002 and to DE 103 03 122.7, filed Jan. 27, 2003. The disclosures of these prior applications are expressly incorporated herein by reference.

FIELD OF THE INVENTION

The present invention is directed to methods and to a device for controlling the web tension in a multi-web system. Initially, two webs are each processed separately. These two webs are subsequently combined into a strand.

BACKGROUND OF THE INVENTION

A method for controlling the web tension of several webs is known from EP 0 837 825 A2. By use of the respective web tension of several webs, their web tension levels, in relation to each other, are regulated by regulation based on fuzzy logic.

A method for controlling web tensions in the course of multi-web operations is known from DE 100 27 471 A1. Absolute and relative tensions of the webs, in relation to each other, are initially set at the hopper inlet. This is preferably performed by the respective draw-in device.

DE 42 33 855 discloses a device for controlling sheets in respect to the presence of a single or a multiple sheet. The evaluation of measured values takes place here on the basis of fuzzy logic.

SUMMARY OF THE INVENTION

The object of the present invention is directed to providing methods and a device for controlling the web tension in a multi-web system.

In accordance with the present invention, this object is attained by the use of separate global and local control processes. A first, global process controls the tensions of the two webs with respect to each other. A second, local process controls the tension in each of the two webs separately.

The present invention provides a system for the automatic regulation of the web tension for multi-web processing machines, and in particular, for rotary printing presses. Because of its closed-loop regulation, the system of regulation in accordance with the present invention constitutes a considerable further development in comparison to web tension control systems customary in present in rotary printing presses. The system is particularly advantageous for triple- or double-width printing presses.

The regulation concept of the present invention, which is based on fuzzy logic, makes an innovative contribution to increased production dependability and to constant quality in a production process which, in view of costs, is increasingly directed toward less waste and toward fewer manual interventions. The regulation process of the present invention aids the operator during start-up of the press, reduces his participation in the course of controlling the web tension during the production run, and makes a contribution to increased stability in all phases of the production.

On its way through the rotary printing press, from the initial roll changer via the draw-in unit, through the printing units and the superstructure, and into the folding apparatus, a paper web undergoes different states of tension, or tension relief or tension profile. The sort of paper used, such as, for example, the manufacturer, grammation, or paper type, the repeated application of printing ink, and possible dampening water in the course of the offset process, the driven traction elements, such as in the draw-in unit with or without compensating rollers, traction rollers, hopper inlet rollers, as well as speed changes, affect the actual tension profile of the paper web inside the press. The regulation of a constant web tension during multi-web operations is even more demanding and complex. In such multi-web operations, the relative tension of the individual paper webs, in relation to each other, at the superstructure, at the hopper inlet and in the folding apparatus is of importance for maintaining optimal web running and printing conditions.

In modern newspaper offset printers, web tension systems, on the basis of PID control devices, have already been realized in the area of the roll changers and draw-in units with a compensation roller. The downstream-situated traction devices in the press, typically downstream of the printing groups and in the hopper inlet, however, are not comprehensively included and regulated. Therefore, the coupling of the traction elements corresponding to the production situation, to form a comprehensive, self-regulating web tension system, is a particular advantage of the present invention.

By the provision of the intelligent web tension regulation, in accordance with the present invention, it is intended to assure an optimal web tension profile of each individual paper web within the press, as well as to assure an optimized tension profiles of the individual paper web, in relation to each other, in order to increase the start-up dependability, by the provision of fewer down times as a result of malfunctions, to achieve a uniform print quality, by fewer differences in registration, and to improve the running dependability of the press during multi-web operations.

With the present regulation of the subject invention, the software, on the basis of fuzzy logic, sets the optimum tension level within the paper webs as a function of the situation at the hopper inlet and as a function of the respective paper profiles, and performs the optimal matching of the webs to each other. The behavior that is typical for a type of each paper web is taken into consideration by use of the paper profiles, i.e. by the use of available information, for example tension-elongation characteristics, regarding the behavior of the defined sort of paper. The knowledge of experts has been stored in the system for the rapid fixation of the setting logic.

The intelligent control system directly regulates the actually measured tension values of the paper web in the processing press, rather than via motor moments that are indirectly based on elongation measuring and control. This results in advantages with respect to efficiency, as well as to positive effects on waste, on production costs and on operational ergonomics.

It is an important point of the present invention, that the regulation, based on fuzzy logic technology, employs expert knowledge, and the operator no longer must perform settings. The measured values regarding the production are obtained by "shopping" and the appropriate units for affecting the tension are directly addressed. In contrast to a discrete control device, with the present regulation system, an ideal total solution is almost always found without having to exactly maintain a defined regulation value, and a total solution, as with a discrete control device, could possibly not be obtained by the use of it. This applies, in particular, to the control device dealing with the single web, which is provided with a specification from the control device dealing with all webs. However, it is advantageous if the last mentioned control device operates, by the use of fuzzy logic, in order to specify, if required, compromise solutions for conditions to the first mentioned control device.

BRIEF DESCRIPTION OF THE DRAWINGS

Preferred embodiments of the present invention are represented in the drawings and will be described in greater detail in what follows.

Shown are in:

FIG. 1, a schematic depiction of a printing press with several webs, in

DESCRIPTION OF THE PREFERRED EMBODIMENTS

Figure 1:
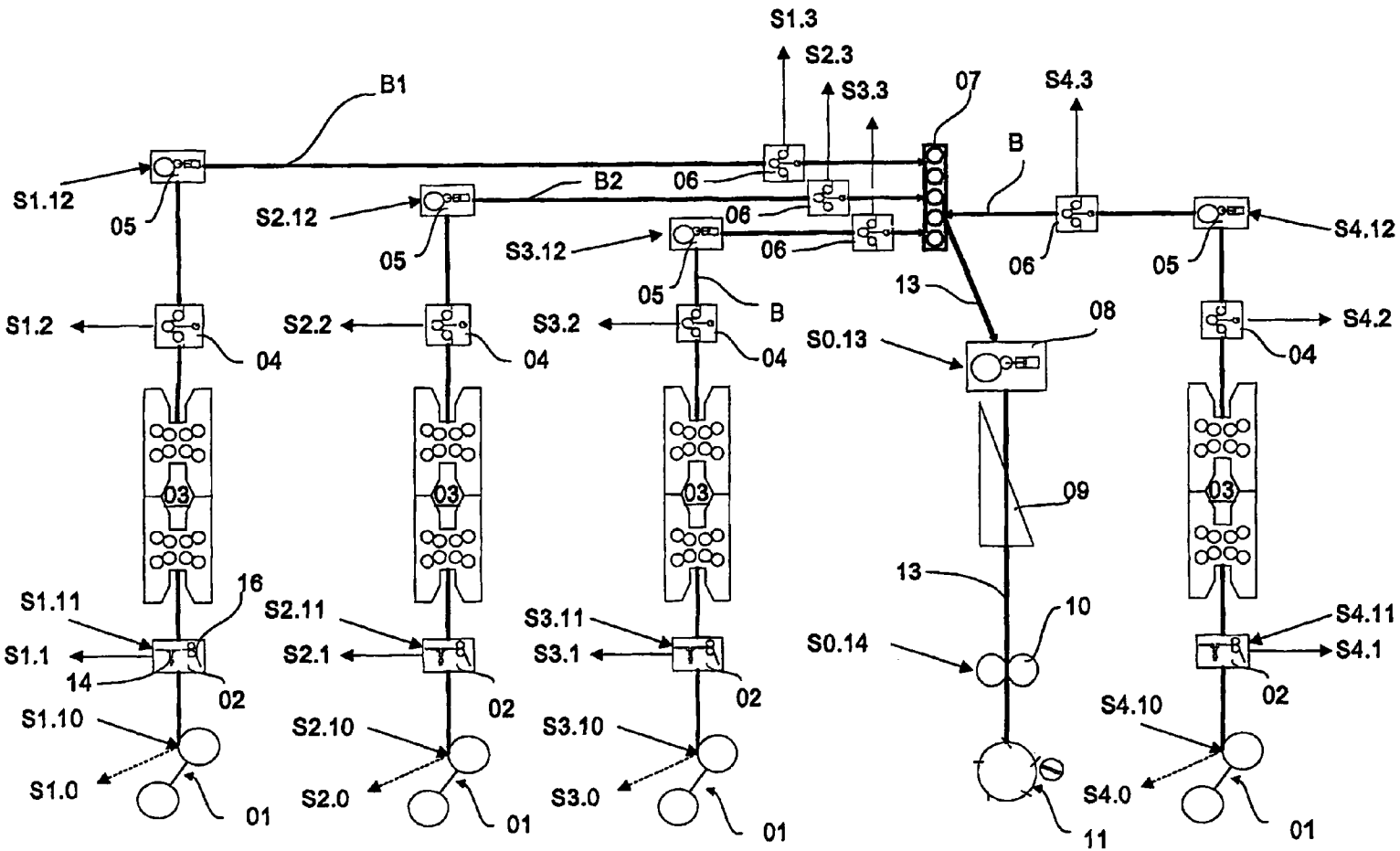

Paths of several webs, such as at least two webs B1, B2 and for example, of four webs B1, B2, B3, B4 of material, for example of four paper webs B1, B2, B3, B4, through a processing press, and in particular, through a printing press, are shown schematically in FIG. 1. Also shown are schematically represented units, which substantially affect the web tension while the webs are passing through the press.

The web B1, B2, B3, B4, which will be explained, by way of example, in connection with the web B1, is fed in from a supply device 01, for example a roll changer 01, and passes through at least one traction device, or braking device 02 for its conveyance and for setting of a web tension, for example a draw-in unit 02, before it passes through a processing stage 03, such as, for example, at least one printing unit 03 having one or several printing groups. The draw-in unit 02 can simultaneously represent an actuating member 02 for setting the tension upstream of the printing unit 03. Following a last print location assigned to the web B1, the latter passes through a measuring location 04, nDE, which is situated downstream of printing unit 03 for determining the web tension. The web B1 thereafter passes through an actuating member 05 which is adapted for affecting the web tension, such as, for example, a traction roller 05, or a roller/traction group 05. Turning bars and longitudinal cutting devices can be arranged in a superstructure, which is not specifically represented, by the use of which, either uncut webs B1 can be turned or tipped, or webs B1 can be first cut and then turned or tipped. Prior to the entry of the web B1, or of the partial webs into a so-called harp 07, which is a plurality of deflection rollers assigned to several webs B1, B2, B3, B4, or to partial webs, a measuring location 06, vTE upstream of the hopper entry, for determining the web tension is provided for each web B1 or for every partial web. The web tension measuring location 04, characterized as "downstream of the printing unit," therefore means a measuring location 04 located upstream of the actuating member, or traction element 05 following the printing unit 03, or at least upstream of a possibly provided cutting or turning device. Following the harp 07, the web B1, or its partial webs, together with other webs B2, B3, B4 or their partial webs, is brought together into one or several web strands 13, and passes a further actuating member 08 affecting the web tension, such as, for example a traction roller 08 or a roller/traction group 08, such as, for example, a so-called hopper inlet roller 08, before the strand 13 is longitudinally folded by one or by several hoppers 09, for example. Therefore, the web tension measuring location 06 "upstream of the hopper inlet or harp" means a measuring location 06 for the single web or for a partial web prior to the bringing together of plural webs or plural partial webs at the hopper inlet roller 08, or at a different roller, located upstream and assigned to several webs, and downstream of the traction element 05 or, if provided, downstream of a cutting and/or a turning device. If the product is not wound up again, the webs B1, B2, B3, B4, or the partial webs in the strand 13 pass through a further actuating member 10 affecting the web tension, such as a further traction roller 10 or a roller/traction group 10, or folding traction rollers 10, and are transversely folded, at least once, in at least one folding apparatus 11. The previously-mentioned draw-in unit 02 has an actuating member 16 affecting the web tension, such as, for example a traction roller 16, or a roller/traction group 16, or a compensating roller 16 and possibly a separate measuring location 14 for determining the web tension, vDE: upstream of the printing unit 03. The actuating member 16 and the measuring location 14 can also be arranged between the roll changer 01 and the printing unit 03 without being combined into a draw-in unit 02. The separate measuring location 14 can be omitted, if adequate information regarding the prevailing web tension is provided by the actuating member 16, which may be, for example, an actuating member 16 which can be actuated by the use of a pressure medium.

In the printing press represented schematically in FIG. 1, webs B1, B2, B3, B4 from printing units 03 arranged on different sides of the hopper 09, are conducted, by way of example, to the hopper 09. The hopper structure can have several hoppers 09 next to and/or underneath each other, and several strands 13 made of the webs B1, B2, B3, B4 can be conducted to more than one folding apparatus 11. Furthermore, the webs B1, B2, B3, B4 need not each pass through a printing unit 03 in the schematically represented manner, but instead can, for example, after passing through a portion of a printing unit 03, be conducted out of it and can be conducted either immediately to the superstructure, or can be conducted to another printing unit 03 for further processing. However, it is essential that the web tension measuring locations 04, 06, 14, and the actuating members 05, 10, 16 are or will be assigned to the webs B1, B2, B3, B4 for their regulation, which will be explained in greater detail below.

In FIG. 1, the web tension signals S1.1, S1.2, S1.3 from the web B1, or S2.1, S2.2, S2.3 from the web B2, etc., which are obtained by the web tension measuring locations 04, 06, 14, are indicated by arrows. A signal S1.0, S2.0, S3.0, S4.0, indicated in dashed lines, can be obtained from a measuring location which is not specifically identified, and which describes the web tension, can be obtained also in the area of the roll changer 01. Furthermore, the preset values for the actuating members 16, 05, in the form of signals S1.11, S1.12 for the web B1, or S2.11, S2.12 for the web B2, etc. are represented by arrows. For example, the signal Sx.11 represents a preset value or a desired value for the web tension in the draw-in unit 02, and the signal Sx.12 represents a preset value or a desired value for the advance of the traction roller 05. The signals S0.13, S0.14 represent the preset values or desired values, for example the advance, of the actuating members 08 and 10. A possibly existing preset value or desired value for the web tension in the area of the roll changer 02 is identified by S1.10 for the web B1, with S2.10 for the web B2, etc.

Figure 2:
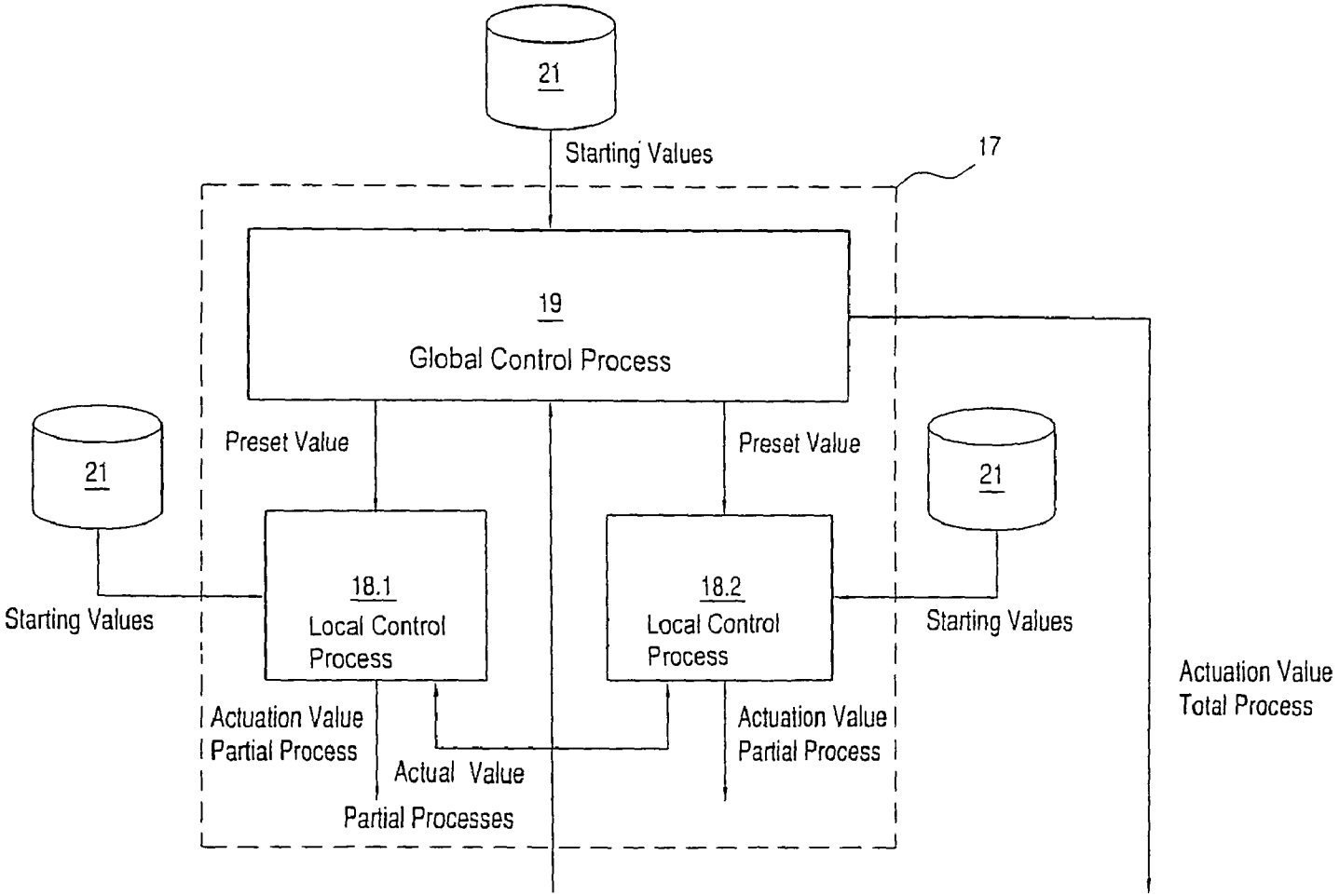
FIG. 2, a schematic representation of a regulation with two control processes, in FIG. 3, a schematic representation of the regulation of the printing press shown in FIG. 1, in FIG. 4, a graphic representation of the progress of the web tension along its path, in FIG. 5, a flow diagram of the web-related local control process in accordance with the present invention, in FIG. 6, a schematic representation of an allocation diagram, and in FIG. 7, a flow diagram of the multi-web-related global control process of the present invention.
Figure 3:
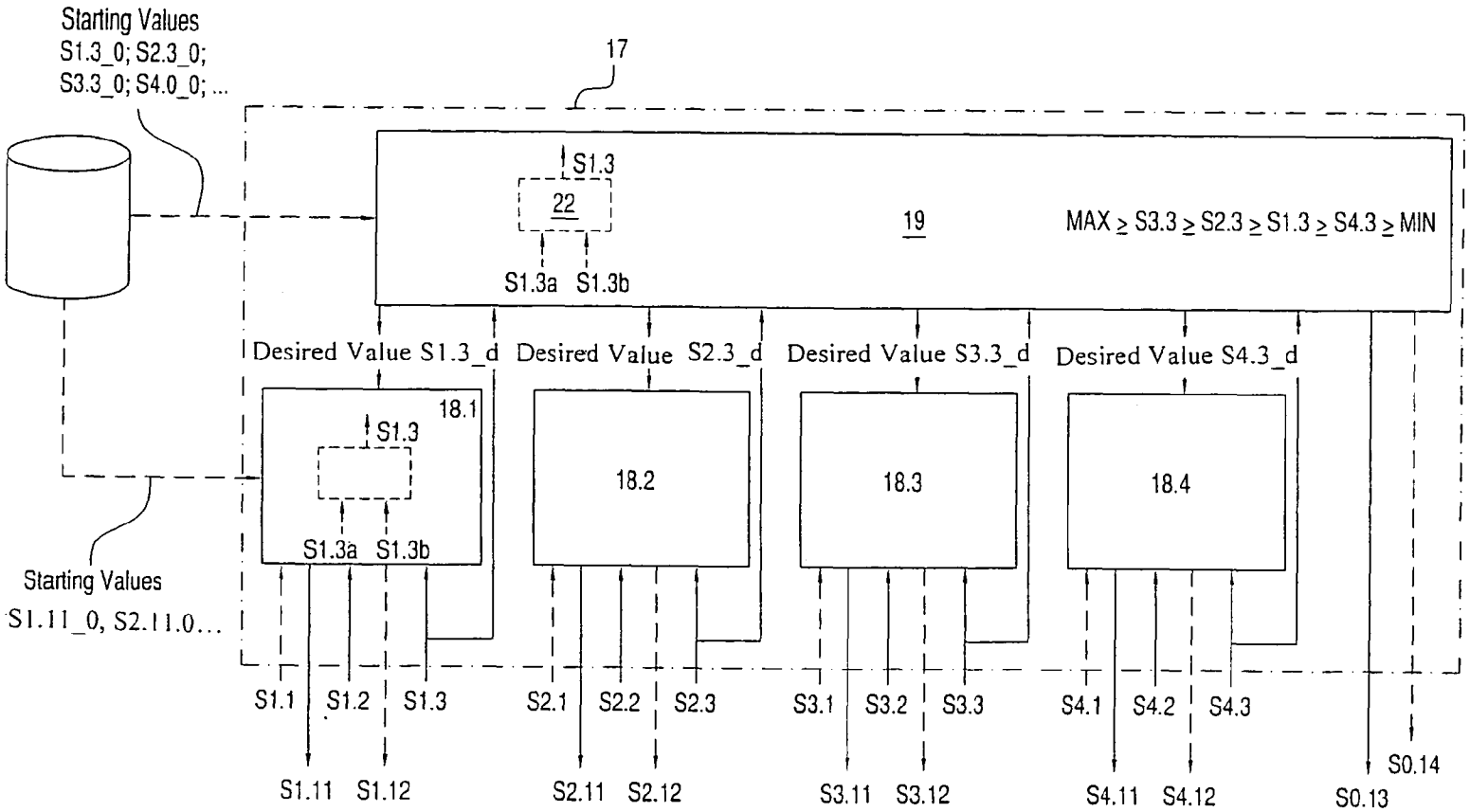

The printing press in FIG. 1 has a control system 17, whose concept will first be explained in principle by the use of FIG. 2, and which is represented in FIG. 3 directly relating to the web tension of several webs B1, B2, B3, B4 in FIG. 1, at least to several webs B1, B2, B3, B4, or partial webs, which together run up on at least one hopper roller 08.

The control system 17 has local and global types of control devices 18 and 19, which differ from each other and which have two partial tasks or two control processes differing from each other. These two "types" of control devices 18 and 19 can be embodied as different hardware components spatially separated from each other, as different software programs communicating with each other, or as two processes, or sub-programs or sub-routines, of a software program. If not explicitly otherwise mentioned in what follows, the terms local control device 18, and global control device 19, or local control processes 18 and global control process 19, are shown with the same reference symbols and should be understood to apply to all of the above mentioned and also to other suitable possibilities of the conversion of the same. As represented in FIG. 2, the control system 17 has several, represented here as two local control devices 18.1, 18.2, each of which is provided with actual values from a respective partial process and which generate, by the use of their implemented logic, one or more actuating values regarding the observed partial process. The global control device 19 is of a higher order than the local control device 18 and receives actual values from the partial processes and outputs, by the use of its implemented logic, preset values for the lower-order local control devices 18.1, 18.2, as well as actuating values directed to the entire process, if required. There is no mutual interaction or communication between the control device 18 and 19. Although they can operate simultaneously, in principle, they operate independently of each other, even though, in part, they observe the same process values, or actual values, and the global control process 19 creates preset values, or desired values for the local control processes 18.

Memory devices 21 are also represented in FIG. 2, from which memory devices 21 starting values can be read into the control device 18, 19 prior to the start of the processes. The starting values are advantageously read in from a common memory unit 21.

At least two measured values from each one of the web paths involved, namely the measured values S1.2, S2.2, S3.2, S4.2 for the web tensions, are provided to the control system 17 in accordance with FIG. 3 for example from the measuring location 04, configured as a direct measuring roller 04, downstream of the respective printing unit 03, as well as the measured value S1.3, S2.3, S3.3, S4.3 from the respective measuring location 06 located upstream of the hopper inlet, or upstream of the harp 07. In the case of the measured values S1.3, S2.3, S3.3, S4.3, and of the measuring location 06, this also applies to turned partial webs assigned to this hopper inlet. In a further development, the web tension signal S1.1, S2.1, S3.1, S4.1 for the respective web tension upstream of the printing unit 03 can be supplied if needed, as shown indashed lines in FIG. 3. The measurement of the web tension is respectively provided by measuring rollers, around which the web B1, B2, B3, B4 is wound.

The control system 17, at least the control device 18, regulates and optimizes the web tensions, preferably by using fuzzy logic. The input values, such as for example the measured values S1.3, S2.3, etc. of the web tensions, which may be appropriately scaled, if required of a web B1 are fuzzyfied, i.e. are used as input values for functions defined in sections, each of which describes a term such as a linguistic value range, for example large, medium or small. The degree to which the input value meets the linguistic meaning of the term or, in case of an overlap of the value ranges, the degree to which it is met, is obtained as a functional value. In the course of the subsequent defuzzyfication, a solid output value, for example an appropriate signal to an actuating member or a new desired value for an actuating member, is generated from the degree to which the individual terms of the linguistic variable have been met. Depending on the result of defuzzyfication, it is possible to provide preset values to one actuating member, to another actuating member or to several actuating members. Which rules are applied is determined by the degree to which the terms of the input values have been met. An above-mentioned example with the two input values, for example with measured values S1.3, S1.2 and with one output value, for example one signal S.12 to an actuating member, such as, for example, the roller/traction group 05 of preset rules, which are available in the form of a table, for example, could be graphically represented as a three-dimensional characteristic diagram, for example. If more input values are entered into a decision process, and/or if it is intended to create several output values, the "characteristic diagrams" are correspondingly multi-dimensional. The control device 19 need not be based on fuzzy logic. Instead, it can be configured in other ways, for example as a PID control device 19. However, the embodiment of control device 19 with fuzzy logic is also of advantage here.

As generally represented above, the control system 17 has the two control devices 18 and 19, which are different from each other and which have two partial tasks differing from each other. The control device 18 regulates the web tension of a single web B1, B2, B3, B4 on its path, and in view of threshold values. The control device 19 sets the tension level, in particular the tension level upstream of the hopper inlet roller 08, of the webs B1, B2, B3, B4 which are combined there, in relation to each other.

The control system 17 has a number of control devices 18, as seen in FIG. 3, which number at least corresponds to the total number of webs B1, B2, B3, B4 or to the number of partial webs, which are to be brought together. All of the control devices 18 have the same architecture, or are programmed in the same way, and are identified by 18.1, 18.2, 18.3, 18.4 for the webs B1, B2, B3, B4 represented in FIGS. 1 and 2. The control device 19, or the process 19, is assigned to the four control devices 18.1, 18.2, 18.3, 18.4, or the four processes 18.1, 18.2, 18.3, 18.4.

In connection with start-up processes, it is advantageous to preset starting values in the control system 17 as desired values which, for example, provide meaningful starting points for a defined web guidance. In the depicted example, it is therefore possible to specify starting values S1.11_0, S1.12_0, S2.11_0, S2.12_0, S3.11_0, S3.12_0, S4.11_0, S4.12_0, S0.13_0 and/or S014_0, for the signals S1.11, S1.12, S2.11, S2.12, S3.11, S3.12, S4.11, S4.12, S0.13 and/or S0.14 as tensions or advances to the control device 18.1, 18.2, 18.3, 18.4, 19. These are preset in a memory for example, and can be a function of the selected production and/or of the web material.

When operating the control system 17, first every web B1, B2, B3, B4, considered solely by itself, is controlled by use of the control devices 18.1, 18.2, 18.3, 18.4, or by use of the processes 18.1, 18.2, 18.3, 18.4, in a first partial task, so that the tension at the measuring location 06, located upstream of the hopper inlet lies between a minimum, for example MIN=8 dN/m, and a maximum, for example MAX=60 dN/m. A second demand made on the first partial task possibly lies in setting the stepping, schematically represented in FIG. 4, of the tensions at the web tension measuring location 14, upstream of the printing unit 03, at the location 04, downstream of the printing unit 03, and at the location, 06 upstream of the hopper inlet, or prior to the bringing together. In addition, the process-related minimum tensions, for example of 8 daN and maximum tensions, of 60 daN must additionally be maintained. It is therefore the task of the control devices 18.1, 18.2, 18.3, 18.4 of the processes 18.1, 18.2, 18.3, 18.4, to adjust the tension of the individual webs B1, B2, B3, B4 at the hopper inlet, and in particular, on their way to it, to the range permitted in principle, and, in addition, to achieve the correct stepping within the web path of the web tensions of the individual webs B1, B2, B3, B4, if necessary.

To achieve this partial task, the control devices 18.1, 18.2, 18.3, 18.4, in what follows, by way of example, for the control device 18.1 of the web B1, are each provided with at least two signals S1.2, downstream of the printing unit 03 and S1.3 upstream of the hopper inlet or upstream of the bringing together of the webs, of the measured tension of the same web B1. The control device 18.1 processes these input values in the above explained manner by the use of fuzzy logic, and generates an output signal S1.11, which acts on the actuating member 16 of the draw-in unit 02. In the simplest embodiment of the control device 18.1, or of the process 18.1, only the two above mentioned input signals S1.2, S1.3 are supplied and an output signal S1.11 is only sent to the actuating member 16 upstream of the printing unit 03. It is optionally possible to additionally supply the control device 18.1 additionally with the signal S1.0 for measuring the tension upstream of the printing unit 03, which signal can also be processed in the logical device.

In an advantageous solution, in accordance with the present invention, the control device 18.1 additionally also acts, with the provision of a signal S1.12, on the actuating member 05 downstream of the printing unit 03, for example by determining and by specifying suitable advancement values. With this embodiment, an improved setting of the course of the tension over the path of the web B1 is possible. In connection with this, the control concept takes place for example in such a way that it is first attempted, by use of the actuating member 16, to meet the requirements regarding minimum/maximum tension and simultaneously, the desired course of the tension. If this is not possible by acting on the actuating member 16 alone, the actuating member 05 is also included.

Figure 5:
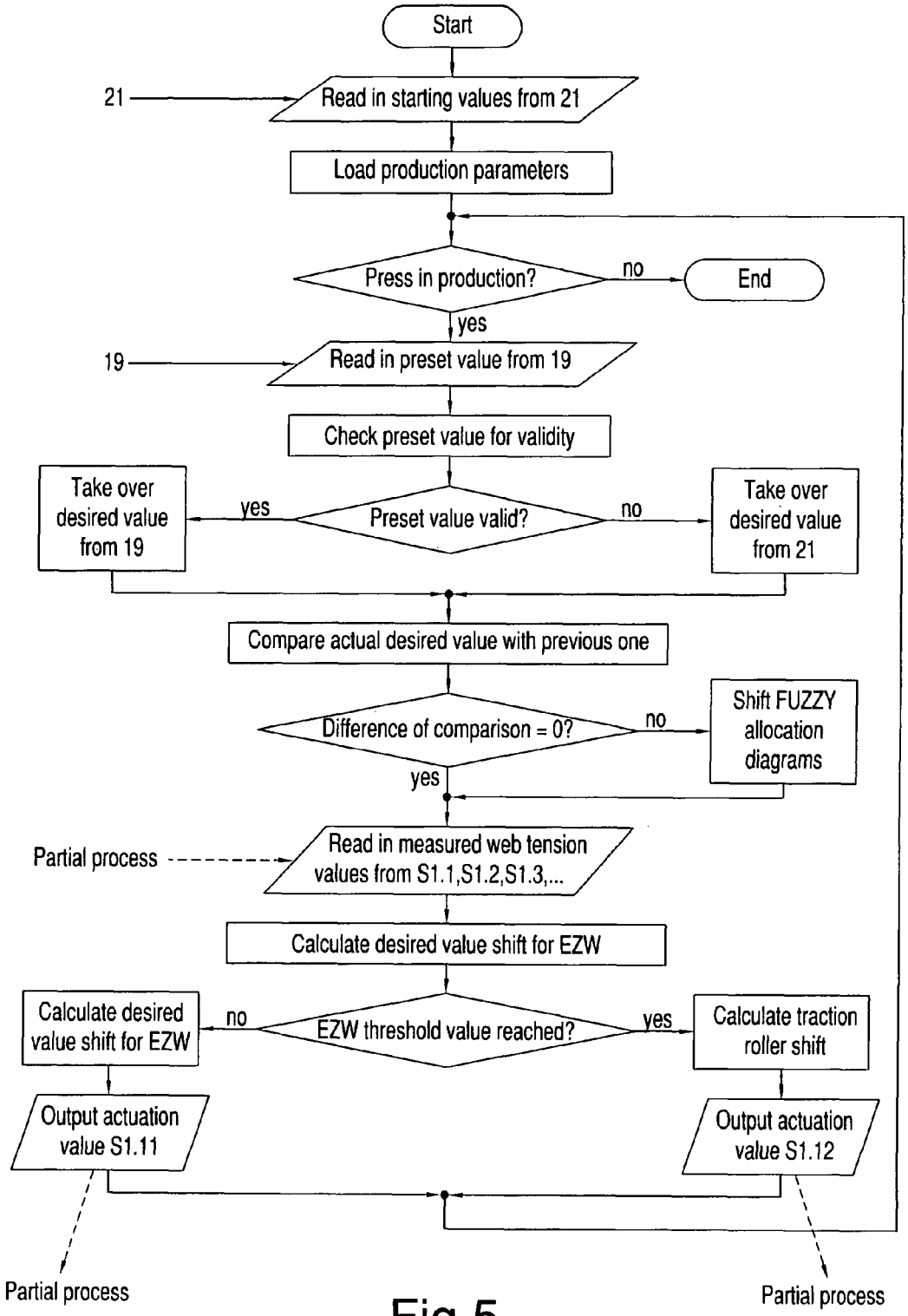

In a substantially self-explanatory manner, FIG. 5 represents the progression of the control process 18.*x* by the use of the example of the control process 18.1. Without repeating was has been said above, it becomes clear that a preset value, in particular for the measuring location 06 upstream of the hopper inlet, from the control process 19 is read in. This actual preset value is compared with the last valid one and, in case of a deviation, one or several of the allocation diagrams on which the subsequent calculations are based is changed, and, in particular, is shifted. The subsequent calculations, for example of a shifting of the desired value for the draw-in unit 02 and/or the calculation of a draw-in roller displacement of the traction device 05, then take place on the basis of the unchanged or changed allocation diagrams, or of the unchanged or changed allocation diagram by the use of fuzzy logic, after the measured values S1.2, S1.3 and, if required, S1.1, have been read in. At the start of production of the press, starting values are read in from a memory device 21 instead of the preset values from the process 19. The partial process prior to the inquiry regarding the press status, i.e. is the press in production? is a part of the initialization of the system. The inquiries are answered in the diagrams with "true" or "yes" (y) w or "false" or "no" (n). The connection with the arrow from the lowest node of the process to the node prior to the inquiry makes it clear that this is a process which is continuously being performed, as long as the press is in production.

Figure 6:
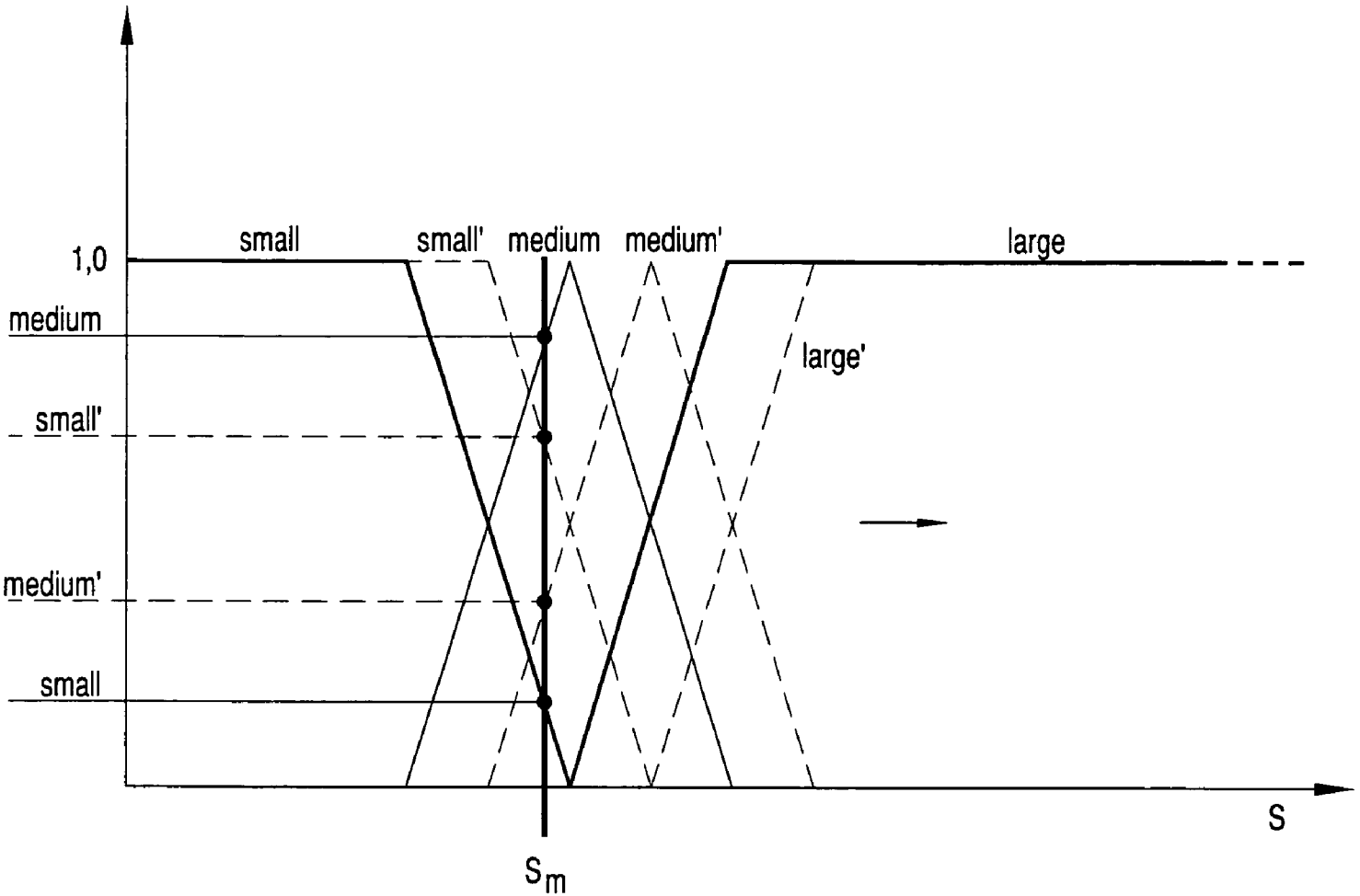

The principle of the above mentioned change or shifting of an allocation diagram is schematically represented in FIG. 6. In a first stage of the diagram, a measured value Sm has first values for weighting of "small" and "medium". After the allocation functions have been shifted, defined in sections, the measured value Sm is faced with different weighted values "small'" and "medium'". This change in the weighting is now reflected in the total view of all fuzzy rules and, in the end, possibly leads to a shifting of the desired values with respect to the actuation value in question, here, for example, the actuating value S1.11 for the draw-in unit 02.

In a second partial task, a check is made by the control device 19, or by the control process 19, whether upstream of the harp 07 the tensions of the webs B1, B2, B3, B4, which are to be combined, are in the desired relationship with respect to each other, and this is controlled accordingly. Thus, for example, the lowest web B1, B2, B3, B4 which comes to rest on the traction roller 08, in this case the web B3, should have a greater tension than the one above it, etc. Therefore, the second task is to step, or to align, the mutual tensions in the webs B1, B2, B3, B4, which are to be conducted, on top of each other, in the area of the hopper inlet. Here, the minimum requirement, that $S_n \geqq S_{n+1}$, applies to all S1.3, S2.3, S3.3, S4.3, etc., if n identifies a web B1, B2, B3, B4, and n+1 identifies the outwardly adjoining web B1, B2, B3, B4. As a side constraint, the following applies to all webs B1, B2, B3, B4: $MAX \geqq S_1 \geqq S_2 \geqq S_3 \geqq S_4 \geqq MIN$, if the index characterizes the sequence of the webs B1, B2, B3, B4 from the inside to the outside. In addition, a rule for the optimum condition advantageously exists which rules states that $S_n \geqq S_{n+1} + \Delta S$, wherein $\Delta S = 2$ dan/m, for example.

Figure 4:
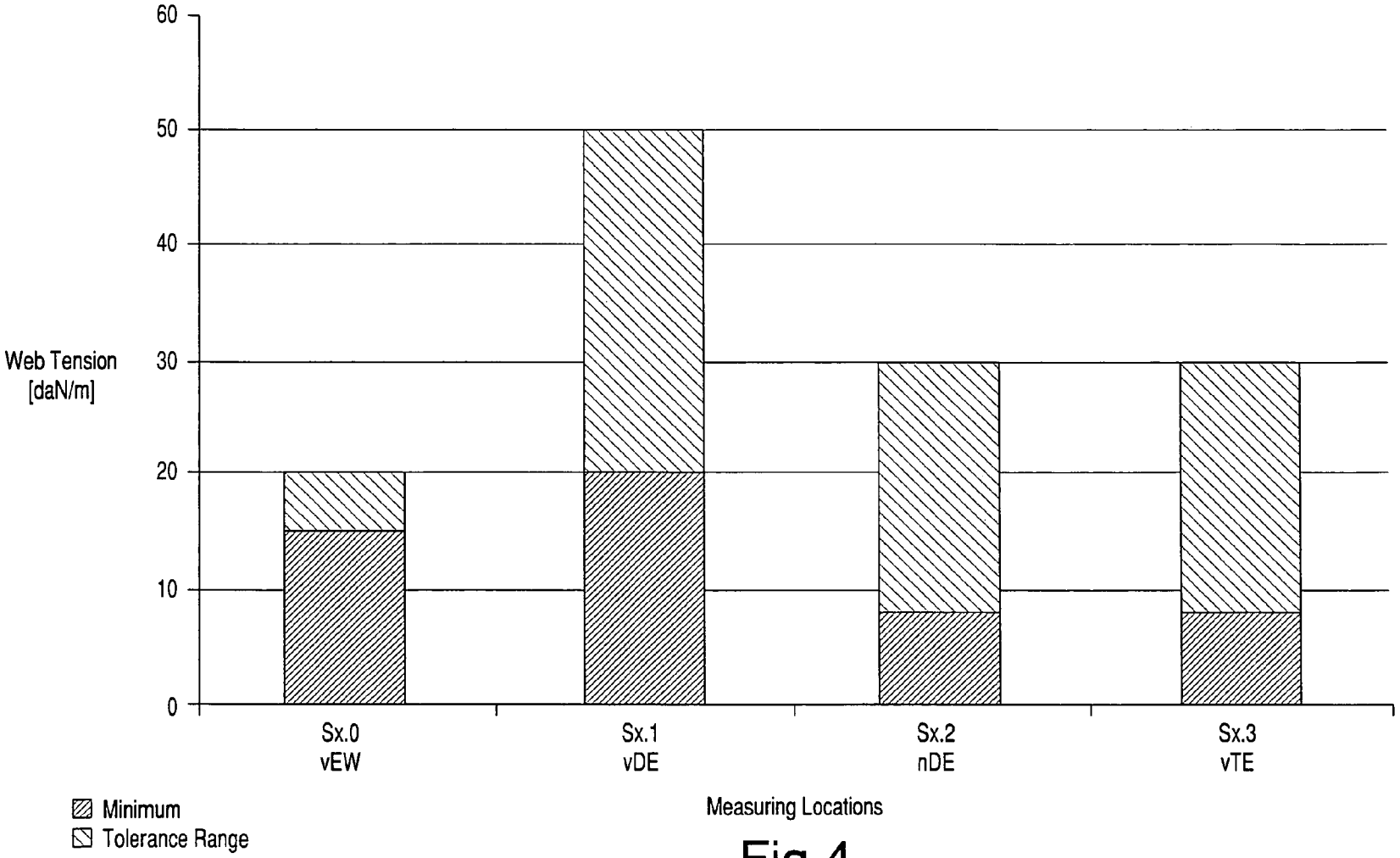

In the second partial task, or the first control process 19, the tensions in the various webs are varied, for example, in such a way that the tension of all of webs B1, B2, B3, B4 upstream of the hopper inlet roller 08 lies within the tolerance range, shown in FIG. 4, upstream of the hopper entry vTE. For this purpose, the signals S1.3, S2.3, S3.3, S4.3 of the measured values of the web tension are supplied to the control device 19 parallel with the control device 18.1, 18.2, 18.3, 18.4. In a further development, fuzzy logic is also the basis for the control device 19, or the control process 19, by the use of which preset values for the control devices 18.1, 18.2, 18.3, 18.4, as well as signals S0.13 and S0.14 for the actuating members 08 and 10, which work together with the strand 13, are generated as output values from the input values, signals S1.3, S2.3, S3.3, S4.3.

Figure 7:
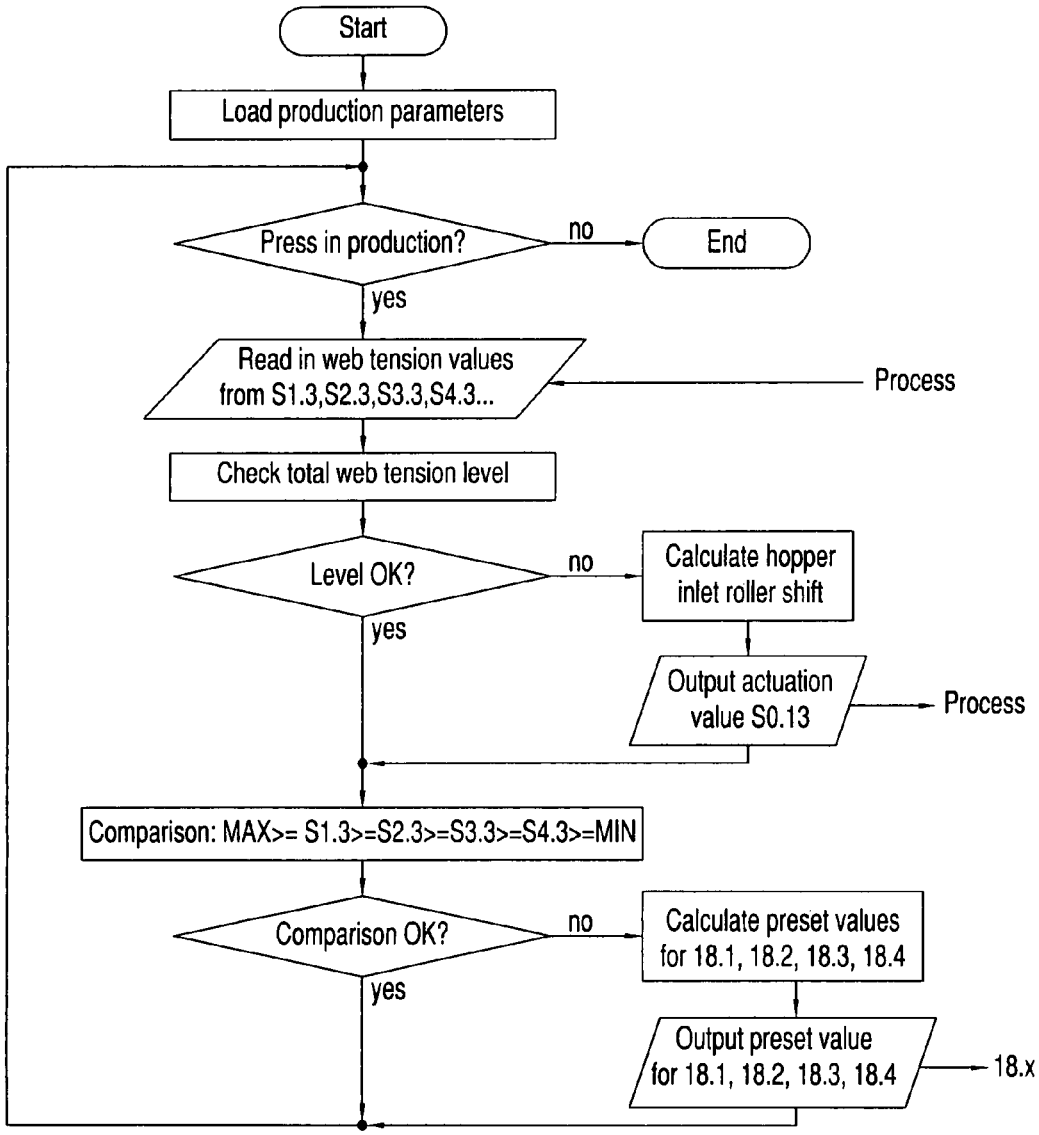

FIG. 7 represents, again in a self-explanatory way, the flow of the control process 19. As can be seen, it is possible to preface the actual partial process for the matching of the web tensions Sx.3, among each other, with a partial process which, as represented in FIG. 7, checks the total web tension level on the basis of the individual measured values Sx.3 and, if required, raises or lowers the total level of all of the webs or partial webs running over the roller 08 by adjusting, for example, the advance of this hopper inlet roller 08. The partial process contains the steps of reading in the measured values, checking the total web tension, and, depending on the result, of calculating and outputting (n) the shifting of the hopper inlet roller, or to leave it as it is (y).

In case of a deviation (f) of the adjustment of the tensions among each other from the preset relationship, MAX≧S1.3≧S2.3≧S3.3≧S4.3≧MIN, and/or the threshold values, preset values are calculated for the respective correction processes 18.*x*, or for the respective correction process 18.*x*, in particular for the measuring location 06 upstream of the hopper inlet, and are output. Here, the calculation can also take place by the use of fuzzy logic wherein, for example, again allocation diagrams, which are the basis of the calculation, are shifted in accordance with the deviations. At the production start of the press, starting values from a memory device 21 are read in instead of the preset values from the process 19. The partial process prior to the inquiry regarding the press status, in production? is a part of the initialization of the system.

In an advantageous embodiment of the present invention, the control device 19, or the control process 19, has no direct influence on the actuating members 16, 05 which are assigned to the individual webs B1, B2, B3, B4, but provides preset values S1.3*d* to S4.3*d* to the control devices 18 from the signals S1.3 to S4.3 by the use of its characteristic diagram. This preset value merely relates to a tension to be maintained upstream of the hopper roller 08 for each web B1, B2, B3, B4, i.e. to a desired value S1.3*d* to S4.3*d* for the tensions to be maintained, for example, at the measuring locations 06 (see, for example, the diagrammatic illustration of FIG. 3). These preset values, for example because of a change in the position and/or form of the terms, or of the input values in the course of the fuzzyfication, are entered in the control device 18.*x*, as discussed above. Therefore, an actuating member 02, 05, 16 assigned to an individual web B1 to B4 is not randomly addressed by two different processes, which would result in an unsteady or even unstable control behavior. In contrast to this, the request from the control process 19 is taken into consideration in the control process 18.*x*. The advantageous performance of this partial process in the control device 18.*x*, in the form of fuzzy logic, now makes it possible for the request or the preset value from the control device 19 not necessarily having to be performed exactly as prescribed, but instead being performed within the scope and in view of the entire control task of the control device 18.*x*. Only the allocation diagrams regarding the preset values from the control device 19 are shifted, and these newly weighted criteria are taken into consideration when determining the optimal, or at least the permissible total state. The connection with the arrow from the lowest node of the process to the node prior to the inquiry of the press status, as seen in FIG. 7, makes it clear that this is a process which is continuously performed as long as the press is in production.

These two control processes 18 and 19, or the partial tasks connected therewith, are cyclically repeated and, corresponding to the measurement results and the results from the logical device, the units affecting the web tension, for example the traction rollers 16, 05, 08, 10, or other, not specifically represented, compensating rollers, etc. are charged, Besides the above mentioned units, such as traction rollers in the draw-in unit 02 and/or one or several traction rollers 16, 05, 08, 10, these units affecting the web tension can also additionally be devices in the roll changer 01 and/or devices in the folding apparatus 11. What had been said above in connection with FIG. 3 then must be complemented by appropriate signals, for example signal S10.10, for the roll changer 01, or by not specifically represented signals for the folding apparatus 11.

In an advantageous embodiment of the present invention, the control of such units, by use of the control system 17, takes place while taking a priority into account. For example, as explained above, in a first priority, the entry of the desired value by the control system 17 is performed only for the draw-in unit 02. If the two above mentioned tasks cannot be performed with this step alone, the traction roller 05 downstream of the printing unit 03 is acted upon. If necessary, in a third step it is permissible to influence the hopper inlet roller 08. However, in the course of this, the level of all of the affected webs B1, B2, B3, B4 is shifted. The actuating members, such as the traction roller 05 or the hopper inlet roller 08, are only used in case the global web tension of all of the webs B1, B2, B3, B4 is not correct, or if the actuating range of the draw-in unit 02, or its actuating member 16, is not sufficient for the desired web tension.

If the requirement of the second partial step, i.e. the desired web tension stepping, cannot be achieved, the logic of the control system, in particular the logic of the control device 19, can be embodied to reach a state which approaches, as closely as possible, an ideal state. Still acceptable limits for the deviation, either relative or absolute, can be preset and, if necessary, can be changed. In addition, in an advantageous further development of the present invention, the control system can be configured to issue a cautionary advice in the case of too great a deviation from the permissible tension profile of a web or the stepping, all of the webs in respect to each other, and, if required, in case of an impermissibly large deviation, to cause the stop of the processing press.

However, in the simplest embodiment, the control system 17 operates with two types of measurement of the tension of each of the involved webs B1, B2, B3, B4, namely web tension measurements respectively downstream of the printing unit 03 and upstream of the hopper inlet, wherein the corrective action takes place, respectively, first at the draw-in unit 02 and, if required, in a second step in the area of the traction roller 05.

As mentioned previously above, following the longitudinal cutting of a web B1, B2, B3, B4, several partial webs, all of which are assigned to a roll changer 01, can be conducted to the hopper 09 along paths which differ from each other. In this case, the tension of each partial web is determined upstream of the hopper inlet, for example, each at its own measuring location 06. These measured tension values, which are assigned to a common roll changer 01, for example S1.3*a* and S1.3*b*, are linked, either before they are conducted to the control system 17, or in the control system 17, i.e. in the control device 18, as well as in the control device 19, to form a value, and are, for example, averaged with or without weighting. The resulting value is employed as an actual value for the control. This linkage can be integrated into the respective control devices 18, 19 as a logical component 22, or as a sub-process 22, which is represented by dashed lines by way of an example.

Preferably the roll changer 01 and the draw-in unit 02 have a closed control loop, in addition to the control system 17, which closed control loop is provided with a specified desired value by the control system 17. The traction rollers 05, 08, 10, 16 are controlled by the control system 17 only in respect to their advancement; i.e. their number of revolutions, or angular position. The units involved are specified by their advantageous embodiments for influencing the tension.

The draw-in unit 02 has a closed loop control. The provision of preset desired values by the control system 17, and in particular by the control device 18, is thus dependably maintained. Draw-in unit 02 acts on the entire web B1, B2, B3, B4 and is considered to be the most important actuating member.

In an advantageous embodiment, the draw-in unit 02 has a roller as the actuating member 16, which roller 02 can be moved counter to the tractive force of the web B1, B2, B3, B4 and which, by the use of pressure means of a specified pressure force, counteracts the tractive force of the web. In this case, no separate measuring location 14 is required, provided the correlation between the charged pressure and the resultant web tension is known.

By changing the advancement with relation to the paper web speed, the traction roller 05 can act on the web tension of the actual web B1, B2, B3, B4, and here constitutes the last chance, upstream of the hopper inlet roller 08, for influencing an individual web B1, B2, B3, B4 with regard to its tension, or stepping.

By changing the advancement, in relation to the paper web speed, the hopper inlet roller 08 can act on the web tension of all of the webs B1, B2, B3, B4.

The folding traction roller 10 can also act on the web tension of all of the webs B1, B2, B3, B4 by a change of its advancement, in relation to the paper web speed. It has direct effects on the cutting registration.

A modular construction, for example, allows the extension of the control to several webs, in case of a separate solution by the use of the hardware, it is merely necessary to add a further control device 18, for example a fuzzy SPS with a program, to each further web B1, B2, B3, B4. It is furthermore necessary to inform the program of the control device 19, for example the master SPS, that it must incorporate a further web B1, B2, B3, B4.

In a pure software solution for the control devices 18 and 19, it is only necessary, in case of an expansion by one web B1, B2, B3, B4, to increase the software by one control process 18.*x* and to inform the program of the control process 19.

Control by the control devices 18 and 19 can run purely sequentially, but can also run parallel, viewed chronologically wherein, however, in view of the tension to be set upstream of the hopper inlet roller 08, for example at the measuring location 06, the control is hierarchically constructed and the control device 19 is of a higher order than the control devices 18.

In an advantageous further development, in accordance with the present invention, the control system 18 is embodied in such a way that a setting for a defined configuration of the print application, found by use of the control system 17, a web path and/or a defined product, can be transmitted as a specified value to the memory device, so that these can be read in as starting values in the future in an identical or in a similar production situation. For this purpose, the takeover of the product or production values takes place from the press control and/or product planning. The takeover as new starting values can be triggered, for example, as a result of a decision of the operators, or by the system itself if the control and/or the control system are configured as a self-learning system in respect to this function.

While preferred embodiments of methods and of a device for the regulation of the web tension in a multi-web system, in accordance with the present invention, have been set forth fully and completely hereinabove, it will be apparent to one of skill in the art that various changes in, for example, the overall size of the printing press, the drives for the rollers and the like could be made without departing from the true spirit and scope of the present invention which is accordingly to be limited only by the appended claims.

What is claimed is:

1. A method for controlling web tensions in a multi-web system including:

providing at least first and second separate webs;

passing said first web through a first web processing step and through a following first web traction element;

providing a first local tension control process for controlling web tension in said first separate web;

measuring said first web's tension and generating a first web tension measurement value;

controlling said first web's tension using said first local tension control process to generate a first local tension control value;

passing said second web through a second web processing step and through a following second web traction element;

providing a second local tension control process for controlling a web tension in said second web;

measuring said second web's tension and generating a second web tension measurement value;

controlling said second web's tension using said second local tension control process to generate a second local tension control value;

combining said at least first and second separate webs into a web strand, said first and second local tension control processes controlling said web tension in each of said at least first and second separate webs prior to combining said at least first and second webs into said web strand;

providing a global tension control process for controlling relative web tension between said first and second separate webs, said global tension control process being responsive to said first web tension measurement value and to said second web tension measurement value;

generating, in said global tension control process, at least one desired tension value for one of said first web's tension and said second web's tension;

out-putting, from said global tension control process, said at least one desired tension value to one of said first and second local control processes in response to the measured web tension in one of said first and second separate webs deviating from a selected tension level; and controlling individual web tensions in said at least first and second separate webs using at least one of said at least first and second web traction elements.

2. The method of claim 1 further including providing said web as a paper web, providing said first and second web processing steps in a web processing press, providing at least one control system employing fuzzy logic, using said control system and employing a characteristic diagram, said controlling of said first and second webs tensions taking place independently of each other, using said global tension control process for generating a preset value for a web tensions using said characteristic diagram, supplying said preset values to said local tension control processes operated by fuzzy logic and changing at least one of a portion and form of at least one position of a linguistic description of a fuzzyfication in said local tension control process using said preset value.

3. The method of claim 1 further including using only said local control processes for controlling said tensions in said first and second webs.

4. The method of claim 1 further including using said global tension control process for providing said desired tension values in said at least first and second separate webs using a characteristic diagram for said global control process using said first and second web tension measured values.

5. The method of claim 4 further including comparing said desired values in said local tension control processes, determining a deviation of said desired values with prior desired values and using said deviations for determining new actuating values for traction elements for each of said at least first and second separate webs.

6. The method of claim 4 further including using said deviation for changing one of a position and a form of a term in an allocation diagram of a fuzzyfication.

7. The method of claim 1 further including providing said first and second local web tension control processes different from said global tension control process.

8. The method of claim 1 further including providing said first and second web tensions to said global control process prior to combining said first and second webs, as input values, and generating in said global control process said desired values of said first and second web tension prior to said combining of said at least first and second webs.

9. The method of claim 8 further including providing a hopper in said multi-web system and setting each of said separate webs tensions in accordance with each said separate webs proximity to said hopper in said web strand, said first separate web strand against said hopper having a greater web tension than said second separate web strand remote from said hopper.

10. The method of claim 8 further including providing said global tension control process presetting said desired value for said web traction element for each of said at least first and second webs.

11. The process of claim 1 further including operating said global tension control process using fuzzy logic.

12. The method of claim 1 further including providing each said processing stage as a printing unit, measuring each of said at least first and second web's tensions after said separate first and second printing units, providing said first and second web tensions to said first and second local tension control processes as input values and generating desired values for said first and second web tensions upstream of said first and second printing units.

13. The method of claim 12 further including generating a desired value of a web tension downstream of each said printing unit.

14. The method of claim 12 further including determining said desired value using a prescription in which said web tension documentation of each said printing unit and prior to said combining of said at least first and second separate webs does not fall below a minimum tension and does not exceed a maximum tension.

15. The method of claim 12 further including determining said desired values using a prescription in which each of said separate web tensions directly downstream of each said printing unit and a tension measuring location before said combining of said at least first and second separate webs lies within a tolerance range for said tension measuring location.

16. The method of claim 12 further including providing said desired values of said at least first and second web tensions using said global tension control process.

17. The method of claim 1 further including operating said first and second local control processes using fuzzy logic.

18. The method of claim 17 further including using said desired value from said global tension control process for causing a change in at least one of a position and form of at least one term for a linguistic description of said fuzzyfication in said local tension control process.

19. The method of claim 1 further including transmitting preset values for said at least first and second web tensions to at least one of said local tension control processes and said global tension control process at least no later than a start-up of said web processing step.

20. The method of claim 1 further including operating said at least first and second local tension control processes and said global tensions control process in parallel and each by itself in loops.

21. The method of claim 2 further including providing a hopper having a hopper inlet roller and using said global tension control process for setting said at least first and second web tension upstream of said hopper inlet roller at which said at least first and second webs are combined into said web strand.

22. The method of claim 2 further including using said local tension control processes for controlling each of said web tensions within a permitted range of said hopper inlet roller.

23. The method of claim 2 further including operating said local tension control processes and said global tension control process independently of each other, said global control process generating values for said local tension control processes.

24. The method of claim 23 further including using said local tension control processes and said global tension control process for considering the same process values.

25. The method of claim 2 further including providing at least one of said first and second webs tension at first and second locations after said web processing step and before said combining of said at least first and second separate webs into said web strand.

26. The method of claim 2 further including providing a harp for said combining of said at least first and second webs into said web strand and controlling each of said at least first and second web's tensions upstream of said harp using said global tension control process.

27. The method of claim 2 further including providing said at least first and second web tension measurement values to said global tension control process in parallel with each of said local tension control processes prior to said combining of said at least first and second separate webs into said web strand.

28. A device for the control of web tensions in a multi-web system comprising:

at least first and second webs;

a first web processing stage and a first web traction element located after, in a direction of web travel, of said first web processing stage;

a second web processing stage and a second web traction element located after, in a direction of web travel of said second web, said second web processing stage;

means combining said first and second webs into a web strand after, in said directions of web travel, said first and second web process steps; and a web tension control system usable for setting web tensions in said first and second webs, said web tension control system including a global control device and at least first and second local control devices, each of said at least first and second local control devices being adapted to perform a control function directed to a respective one of said at least first and second webs by use of a measured value of a web tension of a selected one of said first and second webs, said global control device being adapted to perform a control task directed to all of said webs combined into said web strand, said global control device being adapted to generate a value for said at least first and second local control devices on the basis of measured valued of said web tensions brought together.

29. The device of claim 28 wherein each said local control device is in direct, actual communication with said web traction element.

30. The device of claim 28 wherein a number of said local tension control devices corresponds to a number of said at least first and second webs combined together into said web strand.

31. The device of claim 28 further wherein a single said global control device is assigned to said at least first and second local control devices.

32. The device of claim 28 further including a hopper having a hopper inlet roller and wherein each of said first and second web processing steps is a printing unit located upstream of said hopper inlet roller.

33. The device of claim 32 further including a first web tension measuring location downstream of said printing unit and a second web tension measuring location upstream of said hopper inlet roller being provided for each said at least first and second webs, web tension values being presented as input values to said at least first and second local tension control devices for each of said at least first and second webs and further wherein a signal usable to control web tension upstream of said printing unit for each said at least first and second webs is provided by each said local control device as an output value.

34. The device of claim 33 further wherein a signal adapted to control a web tension downstream of each said printing unit is provided as said output value for each of said at least first and second webs.

35. The device of claim 33 wherein a value of each said at least first and second web tension upstream of said hopper control roller is provided to said global control device.

36. The device of claim 28 wherein said local control device and said global control device are provided as one of individual software programs connecting with each other and as two processes in a software program.

37. The device of claim 28 wherein said local control devices and said global control devices are provided as spatially separate components.

38. The device of claim 28 further including a measuring device connected with said web tension control system and containing starting values to control said web tension.

* * * * *